US010321532B2

(12) United States Patent
Bruwer

(10) Patent No.: US 10,321,532 B2
(45) Date of Patent: Jun. 11, 2019

(54) POWER FACTOR DIMMING

(71) Applicant: AZOTEQ (PTY) LTD, Paarl (ZA)

(72) Inventor: Frederick Johannes Bruwer, Paarl (ZA)

(73) Assignee: AZOTEQ (PTY) LTD, Paarl (ZA)

( * ) Notice: Subject to any disclaimer, the term of this patent is extended or adjusted under 35 U.S.C. 154(b) by 50 days.

(21) Appl. No.: 15/472,582

(22) Filed: Mar. 29, 2017

(65) Prior Publication Data

US 2017/0290116 A1 Oct. 5, 2017

(30) Foreign Application Priority Data

Mar. 29, 2016 (ZA) ..... 201602030

(51) Int. Cl.
*H05B 37/00* (2006.01)
*H05B 39/00* (2006.01)
*H05B 33/08* (2006.01)

(52) U.S. Cl.
CPC ..... *H05B 33/0854* (2013.01)

(58) Field of Classification Search
CPC .. H05B 41/3924; H05B 39/083; H05B 39/08; H05B 41/28; H05B 41/295; H05B 41/2827; H05B 41/3925; H05B 41/392; H05B 41/2822; H05B 41/2824; H05B 41/42; H05B 41/232; H05B 41/18; H05B 41/2325; G05F 1/455; G05F 1/00; G05F 1/445; Y02B 20/202; B23K 9/0732; B23K 9/1012; B23K 9/1031; B23K 9/1037; H01F 38/10; H01J 13/48; H02M 7/06; H02M 7/068; H02M 7/15; H02M 1/02
See application file for complete search history.

(56) References Cited

U.S. PATENT DOCUMENTS

| | | | | |
|---|---|---|---|---|
| 5,399,940 | A | 3/1995 | Hanna et al. | |
| 8,373,547 | B2 | 2/2013 | Benya et al. | |
| 8,441,213 | B2 | 5/2013 | Huynh | |
| 8,558,518 | B2 | 10/2013 | Irissou et al. | |
| 8,643,303 | B2 | 2/2014 | Zheng et al. | |
| 8,680,771 | B2 | 3/2014 | Grisamore et al. | |
| 8,912,734 | B2 | 12/2014 | Melanson et al. | |
| 9,024,537 | B2 | 5/2015 | Jelaca et al. | |
| 9,307,603 | B2 | 4/2016 | Zudrell-Koch | |
| 9,474,121 | B2 | 10/2016 | Shaffer | |
| 2012/0068617 | A1* | 3/2012 | Matsuda | H05B 33/0815 315/240 |
| 2013/0147387 | A1 | 6/2013 | Murdock | |
| 2013/0181630 | A1 | 7/2013 | Taipale et al. | |
| 2014/0265880 | A1 | 9/2014 | Taipale et al. | |
| 2014/0265897 | A1 | 9/2014 | Taipale et al. | |
| 2014/0265900 | A1* | 9/2014 | Sadwick | H05B 33/0803 315/200 R |
| 2015/0373802 | A1* | 12/2015 | Kim | H05B 33/083 315/200 R |

(Continued)

*Primary Examiner* — Minh D A
(74) *Attorney, Agent, or Firm* — Mattingly & Malur, PC

(57) ABSTRACT

An intelligent mains power supply dimmer unit and LED lamp combination with improved power factor. The dimmer applies phase-cutting at a first angle for a first period to a mains voltage supplied to the lamp, whereafter the dimmer removes the phase-cutting. The lamp interprets the first angle as a first power level, which is then stored. The lamp retrieves the level after the first period and regulates its consumption accordingly.

16 Claims, 7 Drawing Sheets

(56) References Cited

U.S. PATENT DOCUMENTS

| | | | | |
|---|---|---|---|---|
| 2016/0081161 | A1* | 3/2016 | Phillips | H05B 37/0218 315/151 |
| 2016/0088700 | A1* | 3/2016 | Shaffer | H05B 33/0848 315/200 R |
| 2016/0286633 | A1 | 9/2016 | Juslen | |

* cited by examiner

POWER FACTOR DIMMING

BACKGROUND OF THE INVENTION

Objectives

1. Backwards compatibility of bulbs/lamps to existing phase cut dimmers.
2. Use of new dimmer with old LED bulbs.
3. Improving flicker and power factor of dimmed LED Lamps or other loads.

A big user base of phase cut dimmers exists that won't be phased out soon. When a phase cut dimmer is used to effect dimming, the power factor is ignored by legislation and the power factor of the system becomes poor per definition because only a section of the AC cycle's power is used. In a business where power factor is factored into electricity usage costs, the dimming of lights through phase cut dimming has little or no effect on the cost of using the lamp. This means even if the lights are dimmed to 50% the cost of the electricity is the same as for 100%.

Furthermore, in LED lamps the phase cut dimming has a direct 100% flicker effect unless significant capacitance is added to the lamp circuitry. This will adversely affect the power factor and will in most cases negate dimming. This means the dimmer dial will be turned with no real effect on the light output until the phase is cut very deep, typically past 90 degrees.

Please note that in the following specification both lamp and load are used to designate the element being operated and powered. Although the examples are mostly for a LED Lamp/bulb, the load may also be electric motor, other light source or load type.

It is often mentioned to set the phase cut angle to zero, but this may not be practical in some systems and then this should only mean to introduce as little phase cutting as possible, and the phase cutting is not to limit the output power of the load, but rather for other considerations.

SUMMARY OF THE INVENTION

There are two independent parts to the solution, each working on its own but combining to be a total solution i.e. to provide an intelligent dimmer/lamp.

i. The one element is the dimmer that must be able to operate in both three-wire (Live, Neutral) and two-wire (live only in and out) modes. Trailing edge phase cutting is recommended to avoid minimum holding current requirements. This is very relevant with LED lights, especially when being dimmed.
ii. The LED bulb or lamp for retrofit use (e.g. A60 etc.) could be designed to operate with older phase cut dimmers and help maintain holding currents for leading edge dimmer (TRIAC based) operation. However, the bulb should be intelligent to reduce the current through the LED's to effect dimming and to reduce wasted power when not working with TRIAC dimmers.

The key improvements/aspect in the intelligent dimmer/lamp system comprise:

- to effect dimming of the light output (or other load such as fan speed) without requiring phase cutting of the AC signal on a continuous basis.
- to set a correlated colour temperature of a light source using phase cutting of the AC power on a temporary basis.
- to derive power in the dimmer without completely switching OFF the power to the load (lamp).

In a first embodiment, when the dimmer switch is activated (switched ON) the signal is subjected to phase cutting to indicate the level of power required in the lamp. After a predefined period, the dimmer removes the phase cutting (either gradually or in a step) of the AC signal. The dimmer monitors the power being supplied to the load (e.g. the LED lamp) for a short period of time and determines if the power changes when the phase cutting is removed. If it does not change proportionally to the phase cutting being removed, the lamp or load is deemed to be compatible with the intelligent dimmer/lamp and the dimmer passes the AC signal through cleanly.

If the load power changes proportionally back to full power when phase cutting is removed, the load is seen as a regular load and phase cutting is restored in the dimmer to maintain the user selected reduced power level.

In another embodiment, the load (e.g. LED lamp) stores the previous selected power level in memory, as does the dimmer. When the user activates the dimmer switch to pass power to the lamp, the intelligent dimmer/lamp start from levels set when switched OFF before. If the user did not change the dimming level of the dimmer switch, the dimmer switches ON without phase cutting and monitors the power used by the lamp. If the power usage corresponds to the power as set before because of the memory function in the load, the dimmer pass the AC through uncut. The system now operates at a set dimmed level without any phase cutting of the AC power.

However, if the dimmer switch is activated and the power level of the dimmer switch set through the user interface has been changed or the load use a different level of power, the dimmer introduces phase cutting to restore the power level as selected by the user on the dimmer switch.

In another embodiment, the dimmer switch may remove a half cycle or multiple half cycles to signal/communicate to the load that the power level has now been set before removing the phase cutting gradually or instantly whilst monitoring the power usage for change. If the power changes then the load is recognized as being incompatible with the intelligent dimmer and the phase cutting of the AC power is resumed at the user selected level. However, if the power usage does not change when the phase cutting is removed, the phase cut angle is minimized or set to zero and the AC power passed through unaffected.

In an embodiment, the LED bulb or load according to this invention monitors the phase cut angle and selects the power accordingly so that when the phase cutting is removed, the power output of the load is kept the same as when the phase cutting was active. This is done through the reduction of current in the load. The selection of power output level is made after a predetermined period of constant phase cut angle or upon receiving a signal or command from the dimmer/user switch, to lock in the power level.

If the phase cutting is gradually removed the current through the load (e.g. LED lamp) is gradually and proportionally reduced. If the phase cutting is instantly removed the current is instantly reduced to reflect the selected power level.

If a load designed in accordance with this invention is used with a conventional (leading- or trailing edge) dimmer the user can also choose to remove the phase cut dimming to also benefit from the advantages gained in power factor improvement and flicker reduction. In an embodiment, the user can perform an OFF/ON switch (toggle) action to set the power level in accordance with the phase cut angled active at the time. The load can then select this level (and store it in memory) for usage, even if the dimmer dial is returned to full power (minimal phase cutting). In another embodiment, the load may set the level after a predetermined period of time (and indicate this to the user) and thereafter the dimmer switch may be returned to full power (minimum phase cut) without affecting the load power.

The load will remain at this level until a future change in the phase cut is detected.

In a two-wire system the dimmer switch may introduce a switch resistance to create a voltage drop over the switch on order to power the dimmer unit. In an embodiment, this resistance may only be introduced when the power available to the dimmer unit drops below a predetermined level. The resistance may be controlled to result in a specific voltage drop required for the operation of the dimmer electronics at the current used by the load. The resistance may also only be introduced for short periods. Short periods of higher resistance in the dimmer switch may be beneficial to reduce the heat created in the dimmer switch unit.

The load according to this invention must be able to control the current used in the load in order to set different power levels. The power level may be selected through toggled switching of a normal wall switch, commands received over the power lines, commands received via wireless communication or through the phase cut angle of the AC power cycle.

To keep the power in the load constant in an embodiment where the AC power is submitted to phase cutting and then the phase cutting is removed, the current through the load must be adjusted in proportion to the phase cut angle change. For example, once the level has been selected through the phase cut angle, the current must be reduced as the phase cut angle is reduced.

In a further embodiment, the CCT (correlated color temperature) of a light source (e.g. LED lamp/bulb) may be selected using a phase cut dimmer. Using commands transferred via the power line (ON and OFF AC cycles) or other command communication mechanisms, a light source designed in accordance with this invention may be controlled to select a CCT according to the phase cut angle introduced by the dimmer switch. This CCT selection may be stored in memory and will remain selected until a new selection is made through the use of phase cut dimming or another command transfer mechanism. The phase cutting is then removed to restore the set power level and CCT is maintained at the chosen level.

The dimmer switch may monitor power usage of the load for transferring to the cloud. The power usage monitoring may specifically include the power factor.

Elapsed time or the number of power ON and OFF switching (toggles) may also be used to determine CCT or power adjustments.

Although adjustments on the dimmer are mostly referred to as being done by rotating a dial, it may also be a touch interface. And the dial may be a digital dial, i.e. just transfers a position or relative change in position to the dimmer control and not a pot for example, therefore the dial can be easily recalibrated for speed or zero position in the dimmer electronics (e.g. in software).

As an example, an intelligent lamp in accordance with this invention may offer the following functionality:

a) For Operation with Toggle Switch Dimming— from an OFF state (off for longer than 5 seconds) when switched on it activates to levels set in memory:

in first x seconds, all is ignored i.e. no action if toggled.

after x seconds, if the power switch is toggled OFF/ON with a dead time of less than y seconds, the LEDs recognize this as a command to dim and reduce the power in the bulb one predetermined level.

if the power switch OFF/ON toggle is repeated before a period of z seconds pass, the bulb will continue to recognize this as a further dimming command and power is change another predetermined step.

if a dimming command was performed and z seconds pass since the previous toggle, the power adjustment (dimming) mode is concluded and the bulb will indicate this with an indication (e.g. flicker or flash).

if in the next x seconds the power switch is toggled (e.g. twice—Off/ON, OFF/ON) the bulb will enter a correlated color temperature adjustment mode. If no further toggle(s) was done, the bulb will enter normal operation and store the set values in memory.

In the CCT adjustment mode the CCT value may adjust the CCT "n" degrees per toggle of the power switch (for example from a set value say 3000K it may step to 3500K) and continue this till a time out i.e. no toggle done in z seconds. In another embodiment, the CCT adjustment mode may be a process of automatically stepping through the CCT range of the bulb until a further toggle command is received to halt the stepping.

if no further toggles are received for a period of z seconds, the CCT is set and stored in memory and the bulb resumes normal operation.

b) Operation with Conventional Phase Cut Dimmer:

When power is switched ON to a bulb (or load) designed in accordance with some embodiments of this invention:

the bulb switches on and check if there is a phase cut present in the power. If there is a phase cut present, and the power to the bulb is toggled (OFF/ON) in the period x<period<z (for example x=3 sec, z=30 sec) after switch ON or change in phase cut angle, the power level value according to the phase cut angle is used as a reference (locked in) and should the dial be turned in a way to reduce the phase cut angle, the bulb will proportionally adjust the current to the light source (e.g. LED's) lower to keep the power (light) output stable. In this way, the phase cut can be set to zero but the light remains as per the selected output level. Any increase in phase cut angle will remove the locked position and result in the reduction of current in the lamp removed.

In another embodiment, the intelligent lamp will automatically indicate (flicker, flashing, dimming) locking the power level set by the phase cut from the dimmer a predetermined period after the phase cut last changed, upon which the dimmer may be operated by the user to minimize any phase cut and the lamp will adjust the power inside it to counter the removal of the phase cutting. It may be required to do this adjustment within a predetermined period after the indication.

If a power setting procedure was entered (power level adjusted or kept the same) and the phase cut was returned to zero by the user, then after a predefined period the bulb will indicate (e.g. flicker, flash) readiness for further commands such as CCT adjustment. If the power to the bulb is for example toggled twice before a z-seconds period passes after the flicker, the bulb enters a CCT adjustment mode wherein the phase cut angle from the dimmer in the AC signal is related to a colour temperature setting. Once the dimmer dial has been stable for z seconds, the CCT value that is derived is set or locked. The bulb indicates this to the user (e.g. flashes, flicker) And the user is expected to return the phase cut angle to zero i.e. full power.

c) Operation of Intelligent Dimmer with Intelligent Lamp (or Load):

The intelligent dimmer is deemed to recognize when it is working with an intelligent lamp, it also uses trailing edge (i.e. no holding current requirements etc.) and can transmit power line commands to the intelligent Lamps.

When a user switches ON the intelligent Dimmer to activate a load (e.g. LED Lamp):

- the lamp is activated at the power level (and CCT if appropriate) stored in memory of the lamp.
- the lamp verifies that no phase cutting is present, and the dimmer verifies the power used by the load is in accordance to the previous set value, if all complies then normal operation continues.
- to change the power level of the load (lamp) the user turns the dial in order to effect the power level change, the dimmer introduce phase cutting into the signal starting with the previous set position and the lamp restores the current to the default levels. Now the phase cut angle can be increased (lower power transferred) or decreased to adjust the light output level. Once the dial has stopped moving for a predefined period, the dimmer will send a power line command to the lamp to freeze the power level or alternatively both sides wait a predetermined period and subsequently starts to minimize the phase cutting of the power. The lamp will keep the output level stable by proportionally reducing the current in the lamp.

For adjustment of CCT the intelligent Dimmer may have a double position switch for example when pressed halfway it can transfer a command from the user to the dimmer and when pressed through (latched) the power to the load may be opened or closed. The User Interface (UI) may also comprise touch sensing for function selection.

- once the CCT adjustment mode has been selected on the dimmer the dimmer automatically takes the intelligent Lamp through the steps to select the CCT adjustment mode, and when the bulb is ready the user can turn the dial to select the CCT. The lamp tries to compensate for the reduction of power caused by the phase cutting, by increasing the current in the lamp proportionally. When the user is deemed to have stopped adjusting the CCT, the dimmer sends a command to the bulb to lock in the CCT and then removes the phase cutting, with the lamp restoring the current to the previously set value.
- in an embodiment, the dimmer may have indications to show the status as it is going through the steps of selecting and adjusting the CCT.
- in an embodiment, the lamp may be equipped with a CCT measuring device to make sure the CCT selected by the user is kept stable when the phase cutting is removed and the current through the LED's is adjusted to compensate.
- In order to reduce the effect of the reduction of power the dimmer in CCT (or output power adjustment) mode may phase cut only some cycles for example every second, third or even fourth cycle. This would ease the effect of changing CCT due to different levels of current through the LED's but since the information is only required to transfer the information from the user as the dial is adjusted not all the cycles need to be phase cut. Obviously, this will only work if the intelligent Dimmer is working with an intelligent Lamp.

It will be appreciated that the teachings of the present invention not only allow a significant reduction in power factor of a load (e.g. LED lamp) while working with conventional phase-cut dimmers and being dimmed or adjusted to a lower power consumption state, but also ease the effort required to realize a load (e.g. LED lamp) which has reduced flickering while being dimmed.

BRIEF DESCRIPTION OF THE DRAWINGS

The invention is further described by way of examples with reference to the accompanying drawings in which.

DETAILED DESCRIPTION OF EMBODIMENTS

The following description of the appended drawings are presented merely to clarify the spirit and scope of the present invention, and not to limit it. It should be understood that these are exemplary embodiments, and a large number of alternative embodiments may exist which still fall within the scope of the claims for the present invention.

Figure 1:
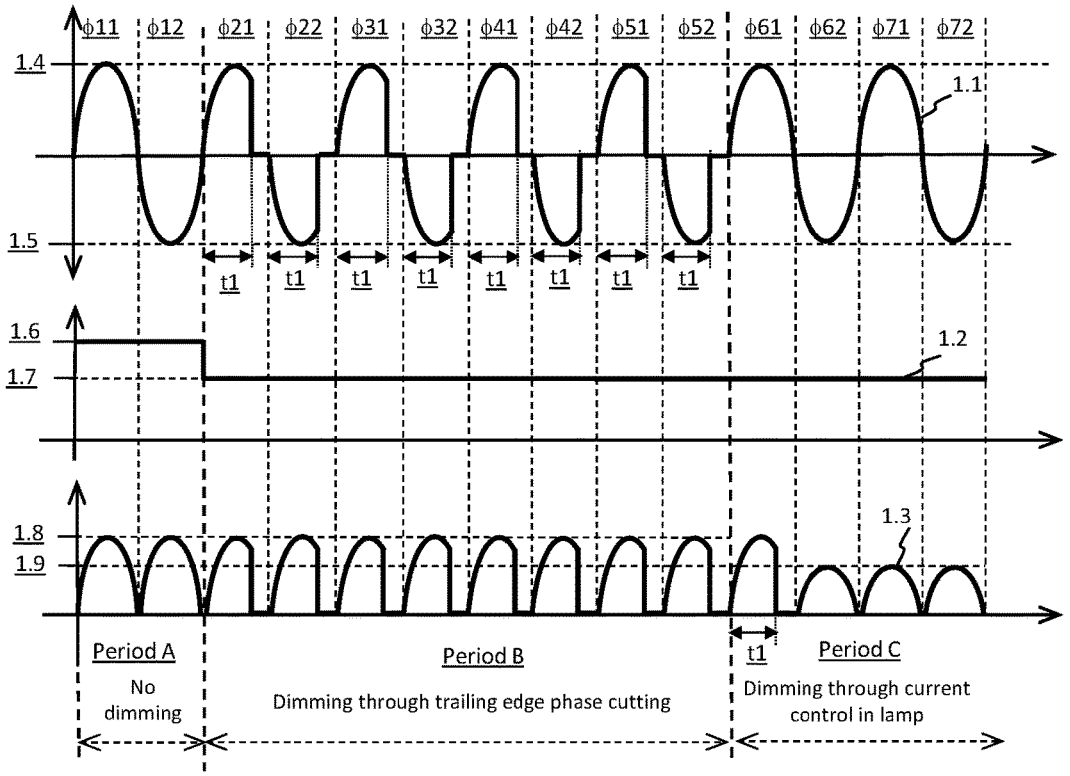
FIG. 1 shows exemplary waveforms for a dimmer and associated LED lamp embodiment of the invention, wherein phase-cut dimming is used to select a dimming level.

FIG. 1 presents exemplary waveforms for an embodiment of the invention which comprise an intelligent dimmer and an associated LED lamp, or another load, supplied by said dimmer, similar to what has been described earlier in the present disclosure. Waveform 1.1 is a qualitative representation of the voltage supplied by said dimmer to said lamp. Waveform 1.2 is a qualitative representation of the average power drawn by said lamp, and waveform 1.3 is a qualitative representation of the current through LED's in the lamp, or of current through another type of load. As is evident from FIG. 1, seven mains cycles are depicted, comprising first half-cycles ϕ11-ϕ71 and second half-cycles ϕ12-ϕ72, divided into three periods, namely Period A, Period B and Period C.

During Period A, the intelligent dimmer which embodies the present invention does not perform a dimming function, and mains voltage is delivered by said dimmer to said lamp practically without impediment, with peak values 1.4 and 1.5 as shown. Correspondingly, the average power drawn by said lamp which embodies the present invention is at a first level of 1.6 during Period A. Current through the LED's of the lamp, or another load, may typically be a rectified sinusoidal waveform with a peak value 1.8 during Period A, as shown by waveform 1.3.

During Period B, the intelligent dimmer which embodies the present invention, after receiving the one or other input or command from a user or another circuit, performs phase-cut dimming, specifically, and preferably (for LED loads), trailing edge phase-cut dimming. As is evident from waveform 1.1, during each half-cycle of Period B, the mains voltage is delivered to said LED lamp, or another load, without impediment for a period t1. After period t1 has elapsed, a switching element in said dimmer is opened, resulting in no voltage (and power) being supplied by the dimmer to said LED lamp or another load, as is evident from waveforms 1.1 and 1.3. The dimming function thus performed typically results in a reduction in the average power drawn by said lamp, or another load, with waveform 1.2 decreasing in amplitude during Period B to a second, lower level of 1.7. It should be noted that waveform 1.2 is merely illustrative, and that the mentioned decrease in the power drawn by said lamp, or another load, can also be more gradual etc. What is paramount is that the power drawn by the LED lamp, or another load, decreases during Period B to a lower level due to said dimming function being performed by said dimmer. Further, according to the present invention, during Period B, said LED lamp, or another load, notes the amount or percentage of dimming performed or effected by said dimmer, and stores this value in memory. It should be noted that Period B need not be four mains cycles long to practice the present invention, but may be any relevant length of time. The LED lamp, or another load, of the present invention also monitors the voltage supplied by said dimmer during each half-cycle, to determine when the dimmer stops to perform said phase-cut dimming, or starts to gradually reduce the amount of phase-cut dimming. This would signify the start of a third period, Period C, during which the lamp, or another load, controls the current it draws to ensure that the same amount of average power is drawn than for Period B when phase-cut dimming was applied.

Period C comprises mains half-cycles ϕ61, ϕ62, ϕ71 and ϕ72 for the exemplary waveforms shown in FIG. 1. As mentioned above and evident from waveform 1.1, said dimmer which embodies the present invention does not perform any dimming during Period C, with mains voltage delivered by the dimmer to said LED lamp, or another load, practically without impediment, and peak values of 1.4 and 1.5. In turn, the LED lamp, or another load, of the present invention controls the current it draws to ensure that the average power drawn during Period C is the same, or closely matches, the average power drawn during Period B, for example at the second level 1.7 in the waveforms shown. As illustrated in a qualitative manner, waveform 1.3 follows a mains rectified sinusoidal pattern with a peak value of 1.9, which is lower than peak value 1.8, during Period C. Voltages and currents as depicted by 1.1 and 1.3 during Period C should result in a high power factor. According to the present invention, and as described during the Summary section of the present disclosure, Period C may typically be much longer than Period B, with the latter only used to allow said LED lamp, or another load, to register the amount of dimming which should be realised with current control once said dimmer stops to perform a phase-cut dimming function. In reality, Period B may only be a fraction of Period C. As such, even-though phase-cut dimming as in Period B results in power factor reduction, the cumulative power factor for Period B and Period C should be relatively high.

Further, according to the present invention, said LED lamp, or another load, may monitor the voltage supplied and the current it draws continuously, or at a high sampling rate. Therefore, when said dimmer stops to perform phase-cut dimming, for example during half-cycle ϕ61, the LED lamp, or another load may detect this at and shortly after a period t1 elapsed. Once it has been determined that said dimmer is not performing phase-cut dimming anymore, the LED lamp, or another load, may control its current to emulate one half-cycle of phase-cut dimming, as illustrated qualitatively by waveform 1.3 in half-cycle ϕ61, with said current controlled during the next half-cycle (ϕ62 in this case) to follow a more sinusoidal pattern. Such an emulation of phase-cut dimming for the first half-cycle of Period C may be done to ensure that the average power drawn by said LED lamp, or another load, remains at the reduced second level 1.7 and do not increase to first level 1.6 during said first half-cycle due to current which increases to level 1.8. in response to mains voltage which is passed through unimpeded.

Figure 2:
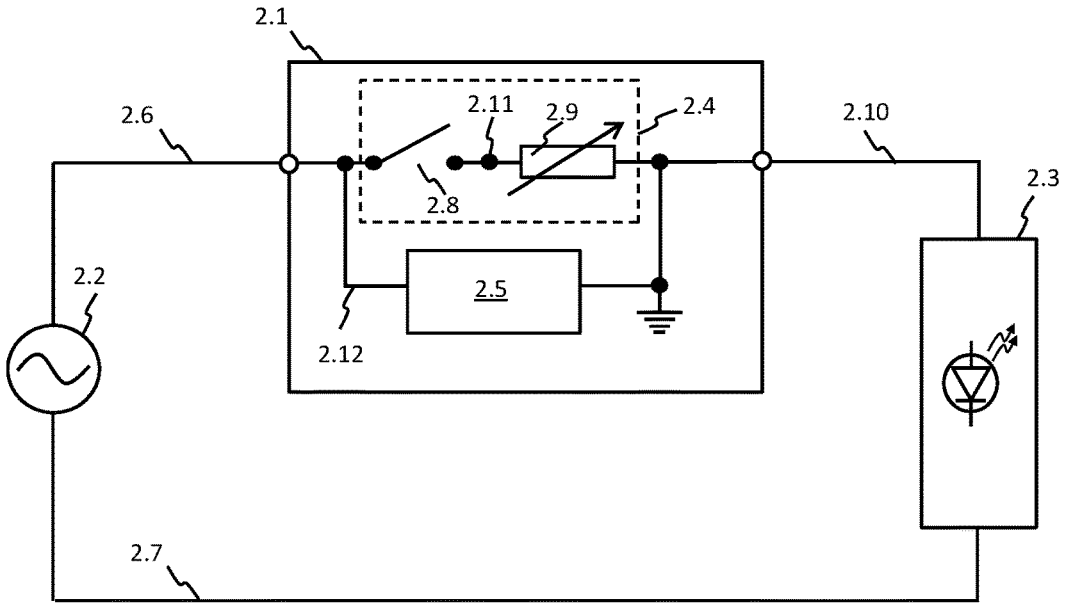
FIG. 2 shows an exemplary embodiment of the invention wherein a supply voltage for a two-wire dimmer is derived from the voltage over a switching element.

FIG. 2 presents another exemplary embodiment of the present invention. A two wire dimmer 2.1, which embodies the present invention, is situated between an AC mains supply 2.2 and a load 2.3, for example an intelligent LED lamp/bulb, which may also embody the present invention as described earlier. Said dimmer 2.1 is connected to mains supply 2.2 by interconnect or wire 2.6 and to load 2.3 by interconnect or wire 2.10. Further, dimmer 2.1 comprises a series switching element 2.4, for example a MOSFET, TRIAC or similar, which may be used to apply phase-cut dimming to the voltage applied between interconnects 2.10 and 2.7. The dimmer 2.1 also comprises an internal supply 2.5, used to power circuitry (not shown) for driving or controlling switching element 2.4, for monitoring or measuring voltages and currents, and for other purposes as required. According to the present invention, switching element 2.4 may be controlled such that the voltage across it during conduction of load current is sufficient to charge a dimmer pool capacitor (not shown) within supply 2.5. For example, if switching element 2.4 is modelled as an ideal switch 2.8 in series with an adjustable resistor 2.9, the resistance of 2.9 may be controlled by dimmer 2.1 to ensure that a sufficient voltage develops across switching element 2.4 for a given load current to charge a dimmer pool capacitor (not shown) within supply 2.5 to an adequate level for powering the circuitry of dimmer 2.1 during a specific period. Preferably, the adjustable resistance 2.9 of switching element 2.4 will only be increased for short periods, to minimize losses, with resistance 2.9 nominally being at a low value when switch 2.8 is closed. For example, if switching element 2.4 is a MOSFET, dimmer 2.1 may operate the MOSFET in its linear region for short periods, which may result in the voltage across 2.4 increasing sufficiently, due to an associated increase in the drain-source resistance of the MOSFET, to charge a pool capacitor (not shown) within supply 2.5. This is merely given as an example, and the present invention should not be limited to the use of MOSFET's for switching element 2.4. In another example, switch 2.8 may be a mechanical open/close switch, as is often found in dimmers, and the voltage for supply 2.5 may be furnished by connecting interconnect 2.12 to point 2.11, before controlled resistance 2.9, instead of directly to interconnect 2.6. In this case, when switch 2.8 is opened by a user, no current will flow towards the load. When the mechanical switch 2.8 is closed, variable resistance 2.9 may be controlled by the dimmer to ensure a sufficient dimmer supply voltage develops over said variable resistance to charge a dimmer pool capacitor (not shown) to a predetermined level.

Figure 3:
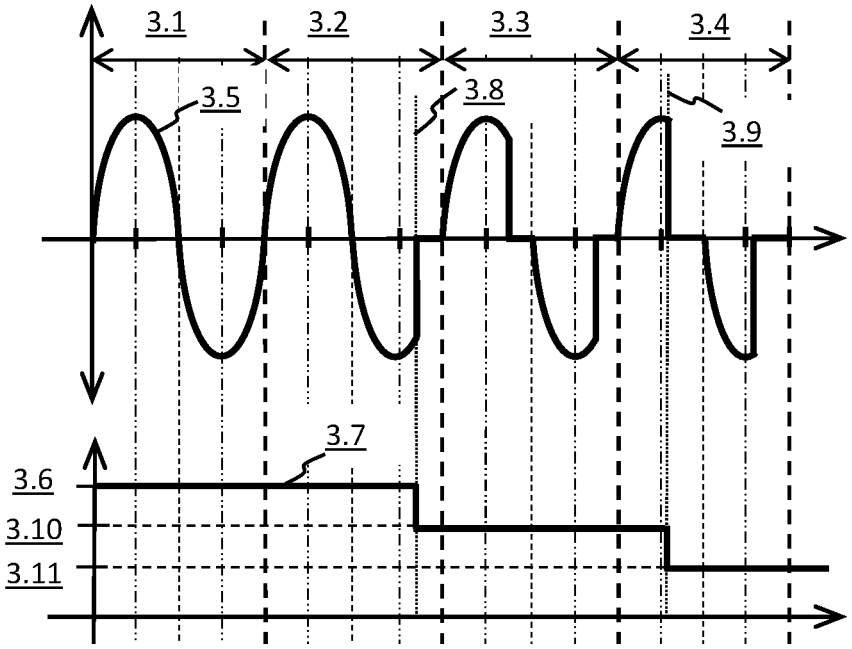
FIG. 3 shows exemplary waveforms for a dimmer and associated LED lamp embodiment of the invention, wherein phase-cut dimming is used to select a CCT or RGB level for the lamp.

In FIG. 3, exemplary, qualitative waveforms are presented for a dimmer and an associated LED lamp, or another load, wherein said dimmer and lamp, or another load, embodies the present invention. The waveforms illustrate how phase-cut dimming, preferably trailing edge phase-cut dimming, may be used to select a Correlated Colour Temperature (CCT) or Red-Green-Blue (RGB) level of the light emitted by said lamp, or another load. Waveform 3.5 represents the voltage supplied by said dimmer to said lamp, or another load, and waveform 3.7 represents a CCT level of the light emitted by said lamp, or another load. Four mains cycles are illustrated, namely cycles 3.1 to 3.4. During cycle 3.1, the dimmer does not perform any phase-cut function, and the mains voltage is passed to the lamp, or another load, practically without impediment, as is evident from waveform 3.5. Said lamp, or another load, may interpret this as a command or input to set the CCT of its light emission to a first level 3.6, which is maintained up to a point in time 3.8, at which said dimmer effects a phase-cut of, as an example, twenty degrees. This is illustrated in periods 3.2 and 3.3 of FIG. 3. According to the present invention, in response to the phase-cut of twenty degrees, said lamp, or another load, may adjust the CCT of its light emission to a second, lower level of 3.10, as is evident from waveform 3.7 during periods 3.2 and 3.3. Further, if said dimmer performs a deeper phase-cut of, for example, forty degrees at a point in time 3.9 during period 3.4, said lamp or another load of the present invention may interpret this as a command or input to reduce the CCT of its light emission further to a third level 3.11. In the preceding, said first, second and third CCT levels may for example be 3000K, 4000K and 5000K. Further, the vertical axis in FIG. 3 may alternatively represent RGB levels without departing from the teachings of the present invention. In addition, similar to the embodiments described earlier, and specifically with regards to FIG. 1, the dimmer of the present invention may maintain a specific phase-cut for a predetermined period, during which the LED lamp, or another load, of the present invention registers the phase-cut angle and correspondingly sets its CCT or RGB level. Hereafter, said dimmer may return to performing no phase-cutting on the voltage supplied to said lamp, or another load, without the lamp or another load changing its CCT or RGB level, at least until a next power Off/On cycle, or another event. The number of periods, duration of specific phase-cut levels and so forth illustrated by FIG. 3 is given as examples for illustration only, and should not be interpreted as limits to the present invention.

Figure 4:
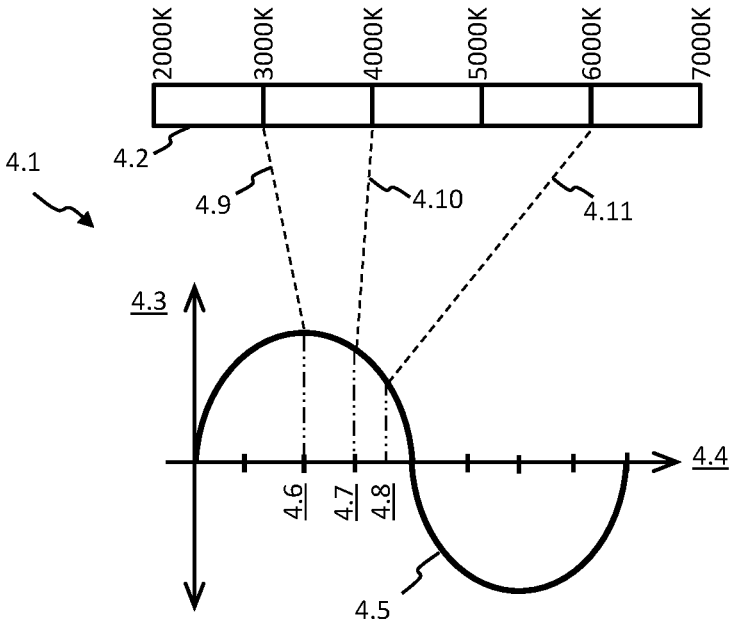
FIG. 4 shows exemplary waveforms for a dimmer and associated LED lamp embodiment of the invention, wherein phase-cut dimming is used to select a CCT or RCG level for the lamp.

FIG. 4 depicts the embodiment presented in FIG. 3 in an alternative manner at 4.1. A qualitative waveform 4.5 represents voltage supplied by an intelligent dimmer which embodies the present invention, or a conventional phase-cut dimmer, to a load, for example an LED bulb embodying the present invention. Axis 4.3 represents amplitude and axis 4.4 time. The dashed lines at points 4.6, 4.7 and 4.8 represents phase-cut angles, for example phase-cuts at ninety degrees, at forty-five degrees and at twenty degrees respectively. According to the present invention, each of these phase-cut angles may be associated with a specific Correlated Colour Temperature (CCT) value, with a range of CCT values shown as a horizontal CCT bar 4.2, as is known in the art. As illustrated in exemplary manner, a phase-cut angle of ninety degrees at 4.6 may be associated with a CCT value of 3000K, as shown by 4.9. A phase-cut angle of forty-five degrees at 4.7 may be associated with a CCT value of 4000K, as shown by 4.10. A phase-cut angle of twenty degrees at 4.8 may be associated with a CCT value of 6000K, as shown by 4.11. It is to be appreciated that phase-cut and CCT values in the directly preceding are purely exemplary, and not preferred values or limits to the present invention. Further, as discussed earlier, once a load embodying the present invention has detected a particular phase-cut angle, associated its value with a specific predetermined CCT value (or RGB value), and stored the associated CCT value in memory, phase-cutting may be removed, either gradually or instantaneously, where-after said load may implement the CCT valued stored.

Figure 5:
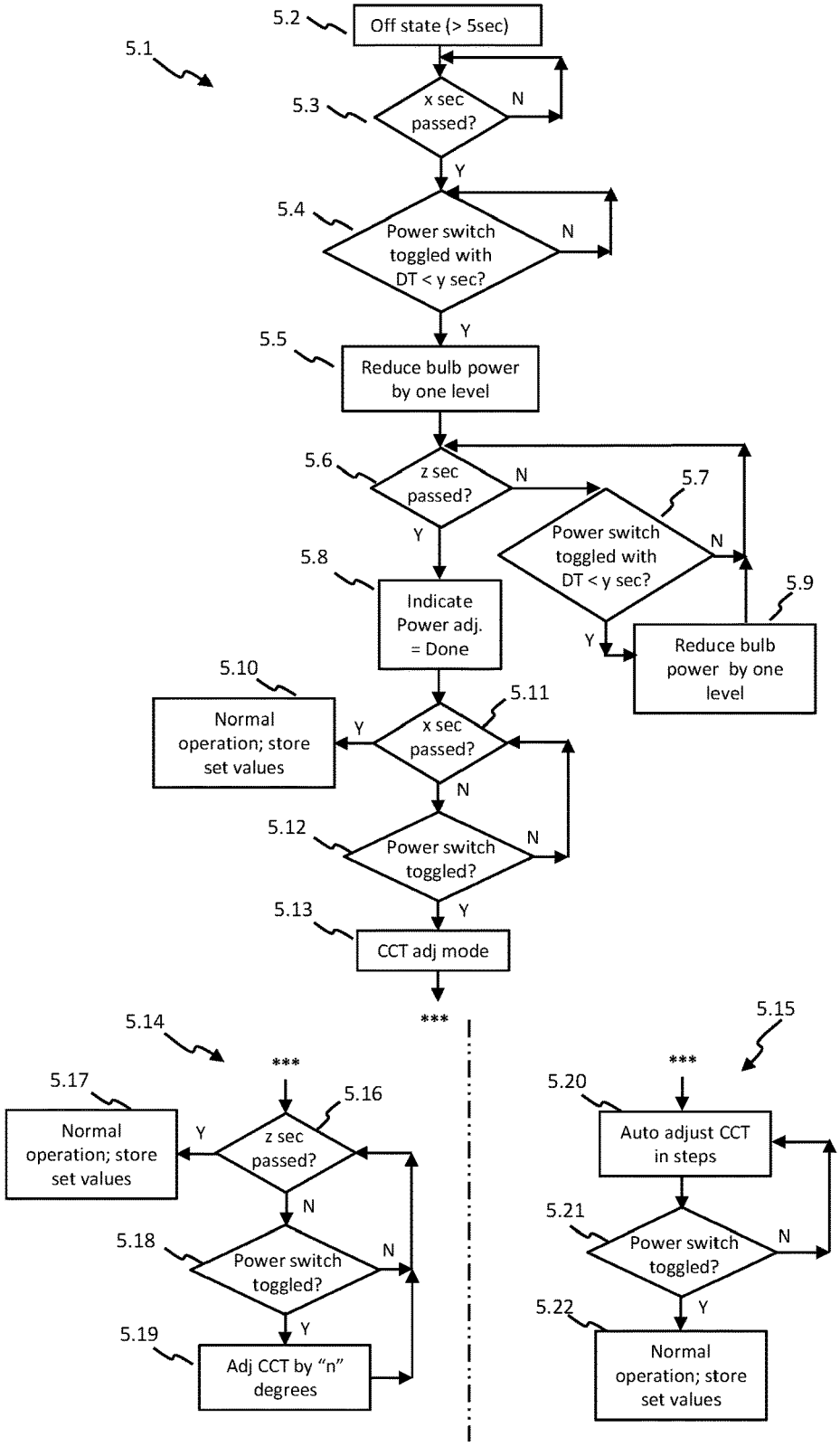
FIG. 5 shows an exemplary flowchart for a method to set the power level and CCT value of an LED lamp embodiment of the invention through toggling of an associated power switch.

FIG. 5 shows a flowchart at 5.1 that describes an exemplary embodiment of the present invention wherein the power level and CCT value of an intelligent load, preferably an LED bulb, may be controlled by toggling an associated mains switch, that is by switching the power supplied to the load on-off-on fairly rapidly a number of times. From an off-state 5.2, the load may wait a certain period of x seconds, as shown by 5.3, before checking, 5.4, if the power switch has been toggled with a specific dead-time DT. Once a legitimate toggle event has been detected, the power consumed by the load may be reduced by one level, 5.5. Hereafter, the load may check whether a specific period of z seconds has passed, 5.6. If not, the load may check, 5.7, whether the power switch has been toggled again. If not, it may return to the check at 5.6. If the power switch was toggled again, the load power consumption by another level, 5.9, followed by a return to the check at 5.6. If the check at 5.6 shows that a period of z seconds has passed, the process proceeds to block 5.8, wherein an indication may be given that the power adjustment process has ended. If nothing happens for a specific period of x seconds, as shown at 5.11 and 5.12, the process proceeds to block 5.10, with normal operation which may be resumed after any new power level values have been stored. However, if the power switch is toggled again, 5.12, the process proceeds to CCT adjustment mode, as shown at 5.13. According to the present invention, CCT adjustment mode may be implemented via either one of the two alternative processes depicted at 5.14 and 5.15. For the process at 5.14, if the power switch is toggled again within a period of z seconds, the CCT level of the load may be adjusted by n degrees for each toggle event, as shown by 5.16 to 5.19. Once a period of z seconds has passed, normal operation may be resumed, with any new CCT values which may be stored in memory, as shown at 5.17.

An alternative process for setting a CCT value is presented at 5.15. After entering CCT adjustment mode at 5.13, a system or load according to the present invention, preferably an LED bulb, may automatically adjust the CCT of the load in a stepwise manner, while checking whether the power switch has been toggled, as shown by 5.20 and 5.21. Once a toggled is detected, the load or system may resume normal operation, with selected CCT values which may be stored in memory, as depicted by block 5.22. In other words, once the load is in CCT adjustment mode, the CCT may change in a stepwise manner, and the user may select a particular CCT value (or RGB value in an alternative implementation) by toggling said power switch.

Figure 6:
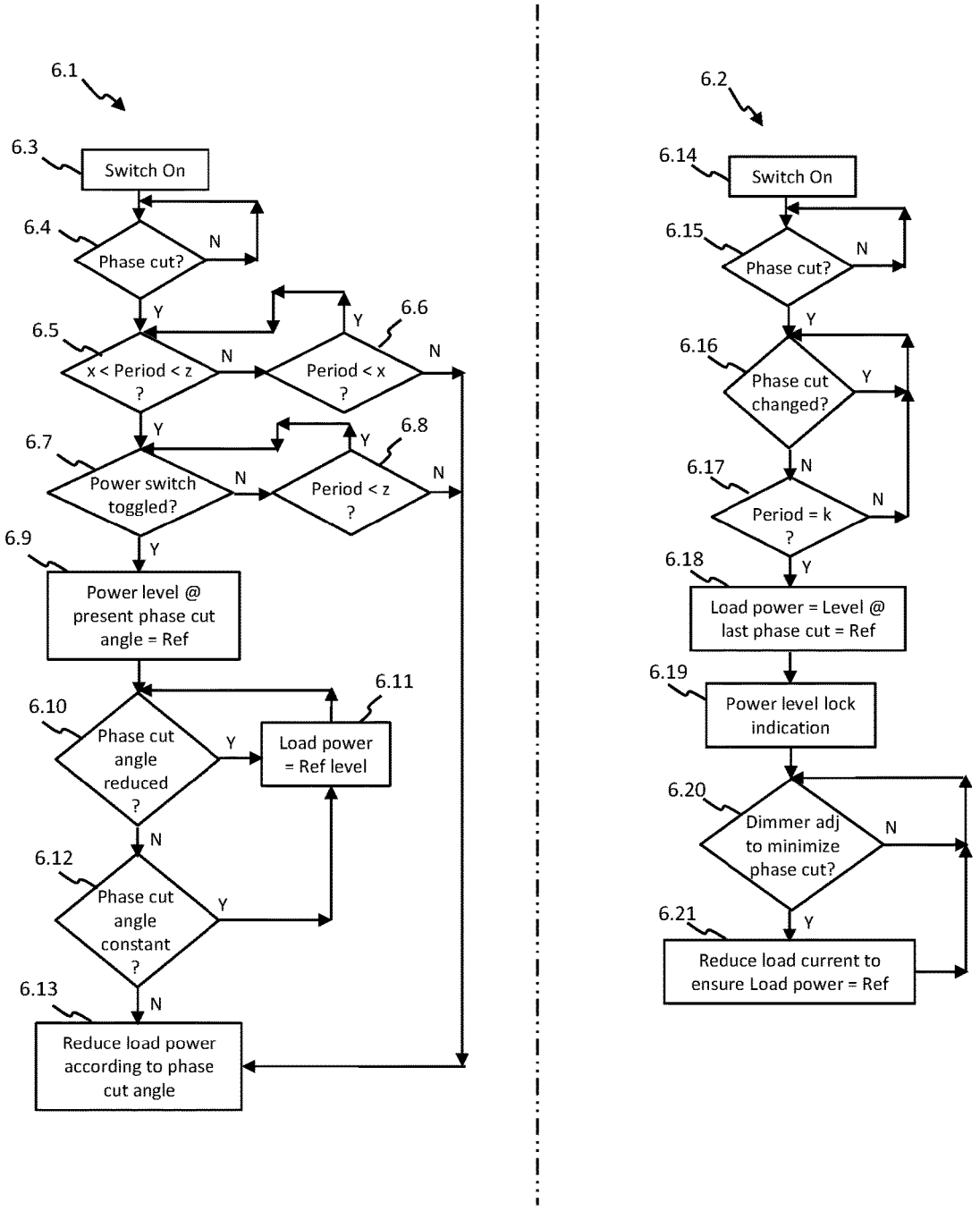
FIG. 6 shows an exemplary flowchart for a method to set the power level of an LED lamp embodiment of the invention which is supplied by a conventional phase-cut dimmer.

An exemplary method to adjust the power level consumed by an intelligent load that embodies the present invention, preferably an intelligent LED bulb, and wherein power to said load is furnished by a conventional phase-cut dimmer, is illustrated in FIG. 6, with two alternative methods depicted at 6.1 and 6.2 respectively. The process or method of 6.1 starts with a switch-on step 6.3, where-after the load of the present invention may check whether phase cutting is present in the voltage supplied by said conventional dimmer, as shown at 6.4. If no phase-cutting is present, the process may return to 6.4, as shown, or it may follow alternative steps, not shown. If phase-cutting is present, the intelligent load may check whether a period of more than x seconds, but not more than z seconds, has passed, as shown by 6.5 and 6.6. If more than z seconds has passed, a time-out may be declared, and the process may proceed to block 6.13, with the load power adjusted to match the present phase-cut angle. If less than z seconds has passed, but more than x seconds, the process may proceed to 6.7 to check whether a power switch, which may be used to interrupt mains power supplied to the dimmer, or to the load, has been toggled. If no power switch toggle event occurs within a period of z seconds, as at 6.8, the method may once again proceed to block 6.13, with load power adjusted to match the present phase-cut angle. If a power switch toggle event does occur before z seconds has elapsed, the method proceeds to block 6.9, whereby said intelligent load may note its power consumption level at the present phase-cut angle, and stored it as a reference power level in memory. At this point in the exemplary process presented in FIG. 6, a user may reduce the conventional dimmer's phase-cut angle to zero, but wherein the intelligent load of the present invention may continue to draw power at said stored reference power level, as depicted by blocks 6.10 to 6.12. For example, once said reference power level is stored, as at block 6.9, said intelligent load may monitor the phase-cut angle applied by said conventional dimmer, as at block 6.10. If the phase-cut angle is reduced, the power drawn by the intelligent load may be set to said reference power level, as depicted by block 6.11. For as long as the phase-cut angle is being reduced (e.g. as the user turns the dial of said conventional dimmer), the process will typically move from block 6.10 to block 6.11 and back. However, once the phase-cut angle is not reduced, the process may move to block 6.12, wherein a check to determine whether the phase-cut angle is constant may be performed. If the phase-cut angle stays constant (e.g. at zero, once the dial of said dimmer is returned to its starting position), the power consumed by said intelligent load may stay at said reference power level stored in memory, as per block 6.11. However, if the phase-cut angle is not constant, as per block 6.12, and it has not been reduced, since block 6.12 can only be reached via a "No" at block 6.10, it may be deemed to have increased. This may prompt the intelligent load of the present invention to proceed to block 6.13, wherein the load power level may correspond to the present phase-cut angle, i.e. the load power may for example be reduced in correspondence to the increase in phase-cut angle.

The process outlined above is merely exemplary, and should not be construed to be limiting, with various alternatives which may be implemented. For example, the alternative process depicted at 6.2 may also be followed by embodiments of the present invention. The process/method at 6.2 starts with a switch-on event 6.14, followed by a check 6.15 to determine whether phase-cutting is present in the voltage supplied by said conventional dimmer. If phase-cutting is not present, the process may return to block 6.15, or it may follow other alternative steps, not shown. If phase-cutting is present, the process may check whether the phase-cut angle remains constant for a certain period, as shown by blocks 6.16 and 6.17. Once the phase-cut angle has been constant for said certain period, the intelligent load of the present invention may lock its power consumption to the level drawn at said constant phase-cut angle, as shown by block 6.18. This may be followed by an indication to a user of said power level lock, as shown by step 6.19. Hereafter, as shown by steps 6.20 and 6.21, said user may reduce the phase-cut angle of the conventional dimmer while the power consumption of the intelligent load stays at the reference level stored or locked on to during step 6.18.

Figure 7:
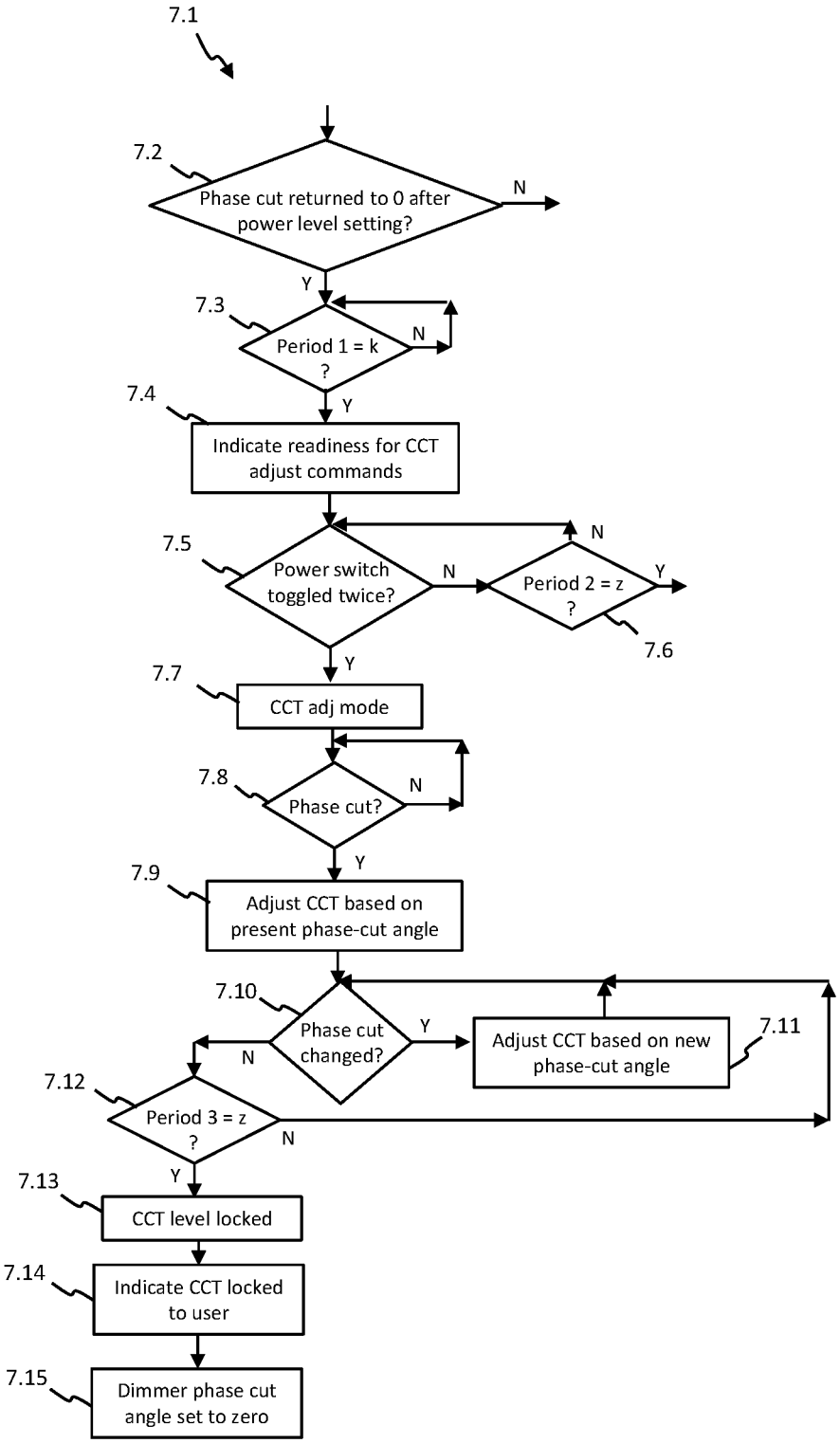
FIG. 7 shows an exemplary flowchart for a method to set the CCT level of an LED lamp embodiment of the invention which is supplied by a conventional phase-cut dimmer.

FIG. 7 presents an exemplary flowchart at 7.1 for a process or method to adjust the CCT value of an intelligent load embodying the present invention, preferably an intelligent LED bulb, and wherein power consumed by said load may be furnished by a conventional, phase-cut type dimmer. The process starts with a check at 7.2 whether the phase-cut angle of said conventional dimmer has been returned to zero after a power level setting process, for example after processes such as those illustrated at 6.1 or 6.2. If not, the process may follow alternative steps, not shown. If said phase-cut angle has been returned to zero degrees, the process may proceed to block 7.3, wherein a check is performed to ensure that a specific first period has elapsed. This may be followed by step 7.4, during which an indication may be given to a user or another circuit that the load or system is ready for CCT adjustment commands. Subsequently, the process or method may move to blocks 7.5 and 7.6 to check whether an associated power switch is toggled twice within a specific second period. If said second period elapses without detection of a double-toggling event, the method may move from block 7.6 to alternative steps, not shown. Said associated power switch may be used to interrupt power supplied to said dimmer or to the load, or may utilized for another function. If the answer to check 7.5 is yes, the process may enter CCT adjustment mode at 7.7. A check is performed at 7.8 to determine whether phase-cutting is present in the voltage supplied to said intelligent load by the conventional dimmer. Once phase-cutting is detected, the method may adjust the CCT value of the load based on the present phase-cut angle, as shown by 7.9. This may be followed by a check 7.10 to determine whether the phase-cut angle has changed. If yes, the process moves to step 7.11, whereby the CCT of the load is adjusted in accordance with the new phase-cut angle, followed by a move back to check 7.10. If the answer to check 7.10 is no, the process may determine whether the phase-cut angle has been constant for a third period, as per block 7.12. Once this has been found to be the case, the process may lock the CCT level in, as per block 7.13. In other words, block 7.13 represents a step wherein the CCT level is set to a specific value, once the phase-cut angle has remained constant for a third period. The locked CCT level may be indicated to the user, as at step 7.14, followed by the phase-cut angle of the conventional dimmer set to zero at step 7.15, i.e. the user may be required to return the dimmer's dial to a position which corresponds to a zero or minimum phase-cut angle once the CCT lock has been indicated.

Figure 8:
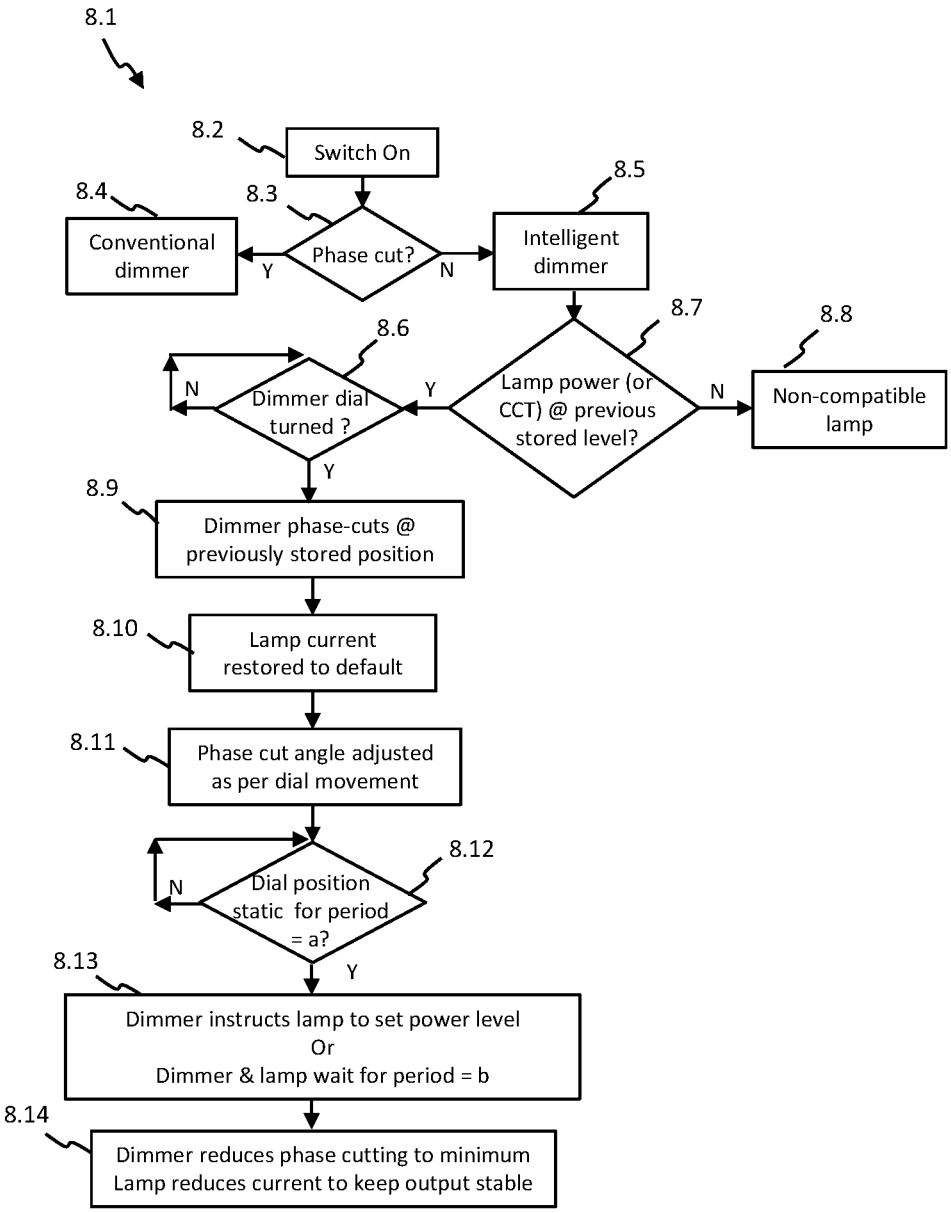
FIG. 8 shows an exemplary flowchart for a method to set the power level of an LED lamp embodiment of the invention which is supplied by an intelligent dimmer of the invention.
Figure 9:
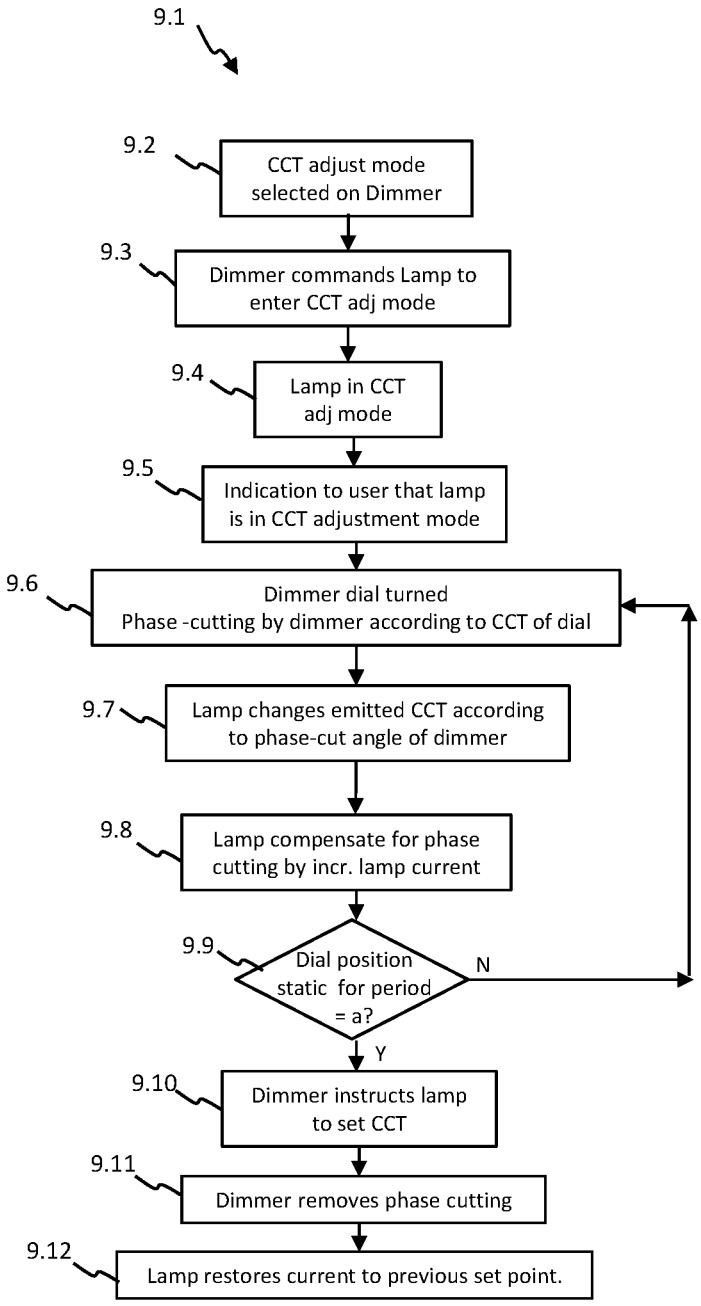
FIG. 9 shows an exemplary flowchart for a method to set the CCT level of an LED lamp embodiment of the invention which is supplied by an intelligent dimmer of the invention.

As stated earlier during the present disclosure, a preferred embodiment of the present invention comprises an intelligent dimmer used in conjunction with an intelligent load, for example an intelligent LED bulb as load. The purely exemplary flowcharts presented in FIG. 8 and FIG. 9 depicts methods which may be used to set the power and CCT levels respectively of such an intelligent LED bulb. The power level setting process at 8.1 starts with a switch-on event 8.2. This may be followed with check 8.3 by the load to determine whether phase-cutting is present in the voltage supplied to the load. If phase-cutting is present, the load deems the dimmer to be a conventional dimmer, as at 8.4, and alternative process steps (not shown) may be followed. If no phase-cutting is present, the load deems the dimmer to be of an intelligent, compatible type, as at 8.5. This may be followed by a check 8.7 performed by the dimmer to ensure that the connected load (lamp) is compatible, wherein the check requires the load to draw power in accordance with a previously stored level. If the power drawn differs, the dimmer may deem the lamp to be incompatible as at 8.8, and the process may follow alternative steps (not shown). If the lamp draws power as expected by the dimmer, the process may continue to step 8.6 where a check may be performed to detect when the dial of the intelligent dimmer is turned. Once turning of the dial is detected, the intelligent dimmer may implement phase-cutting on the voltage supplied to the intelligent load, wherein the phase-cut angle is in accordance with the previously stored intelligent load power level, depicted at 8.9. This may be followed by step 8.10, which may also be concurrent to or precede step 8.9, wherein the load restores current to default levels. In step 8.11, a user may turn the dial of the intelligent dimmer, and phase-cutting may accordingly be performed by said intelligent dimmer, with the amount of light, as an example, generated by an intelligent LED bulb which may increase or decrease dependent on the dial movement direction and whether the dimmer decreases or increases the phase-cut angle. The process may check whether said dial is static for a first period, as at block 8.12. Once the dial has been static for said first period, the process may move to step 8.13 with the dimmer instructing said load, for example via a power line communication command, to set or lock its power level to a reference level which is that consumed upon reception of the instruction. Alternatively, step 8.13 may consist of both the dimmer and the load waiting for a second specific period, during which said dial position is static, to elapse before moving to step 8.14. In step 8.14, the dimmer reduces the phase-cut angle to a minimum while the load reduces its current accordingly to ensure that the power drawn by the load stays constant, or fairly constant, at the level drawn during step 8.13. Naturally, the dimmer may use any of the large number of electronic communication methods known in the art to instruct the load during step 8.13.

FIG. 9 illustrates at 9.1 an exemplary method to adjust the CCT level of an intelligent load, preferably an intelligent LED bulb, with an intelligent dimmer, where said load and dimmer embodies the present invention. The method starts with step 9.2 when the CCT adjustment mode is selected on the dimmer. Subsequently, the intelligent dimmer may command the load (lamp) to enter a CCT adjustment mode, with said load then following said command and transitioning into CCT adjustment mode, as per illustrated steps 9.3 and 9.4. Next, an indication may be given in step 9.5 that the load (lamp) is in CCT adjustment mode. The user may subsequently turn the dial of said intelligent dimmer, as per step 9.6, which may result in phase-cutting applied by the dimmer to the voltage it supplies to the load, wherein said phase-cutting may be in accordance with a CCT value selected by the amount of dial turning or the relative or absolute position of the dial. Subsequently, in step 9.7, the load (lamp) may adjust the CCT of its emissions according to the amount of phase-cutting applied by said dimmer in step 9.6. In step 9.8, the load (lamp) may compensate for the amount of phase-cutting applied by said dimmer by increasing the load current level. Next, the process may check whether the dimmer dial position has been static for a first predetermined period, as shown in step 9.9. Once the dial position has been static for said first period, the process may proceed to step 9.10 wherein the dimmer instructs or commands the load (lamp) to set or store the current CCT value. In step 9.11, the dimmer may remove phase-cutting (instantaneously or gradually), followed by step 9.12, during which the load (lamp) restores load current to a set point stored before the CCT adjustment process, while maintaining the CCT value selected during said process.

The preceding disclosure has merely been made to clarify and describe the invention in an exemplary manner, and not to limit it unduly. One of ordinary skill in the art will appreciate that numerous alternative embodiments exist which may still fall within the scope and spirit of the invention, as defined by the disclosure and the appended claims.

The invention claimed is:

1. A mains power supply dimmer unit and LED lamp(s) combination, wherein said dimmer applies, for a predetermined first period, phase-cutting of a first angle to a mains voltage supplied through said dimmer to said lamp, where-after said dimmer supplies a mains voltage with limited or no phase-cutting to said lamp, and wherein said lamp interprets said first angle as a first power level, wherein said first power level is stored, and wherein the lamp retrieves the first power level after said first period and sets its power level of light emission according to said first power level.

2. The dimmer and LED lamp combination of claim 1, wherein a CCT value for said lamp is set according to a second phase-cut angle applied by said dimmer to said mains voltage for a predetermined second period, said second period starting subsequent to a user input instructing said combination via said dimmer to enter a CCT adjustment mode, wherein said lamp interprets said second angle as a first CCT value, wherein said first CCT value is stored, and wherein the lamp adjusts its emissions according to said first CCT value.

3. The dimmer and LED lamp combination of claim 1, wherein said stored first power level is retrieved after mains power is removed and reapplied to said combination, and wherein said dimmer supplies the mains voltage without phase-cutting to said lamp if a user defined dimming level after said reapplication corresponds to said first phase-cut angle and said lamp consumes power according to the first power level.

4. The dimmer and LED lamp combination of claim 1, wherein said dimmer removes at least one half-cycle of the supplied mains voltage to indicate setting of a lamp power level to said lamp, where-after said dimmer removes phase-cutting of the supplied mains voltage.

5. The dimmer and LED lamp combination of claim 1, wherein said dimmer communicates with the lamp via at least one of the following to indicate setting of a lamp power level to said lamp, where-after said dimmer removes phase-cutting of the supplied mains voltage:

Power line communication;

Wireless communication.

6. The dimmer and LED lamp combination of claim 1, wherein the lamp controls current through LEDs in said lamp to set its power level of light emission.

7. The dimmer and LED lamp combination of claim 1, wherein the dimmer monitors lamp power consumption and power factor.

8. The dimmer and LED lamp combination of claim 7, wherein information on lamp power consumption and power factor is transferred to the cloud.

9. The dimmer and LED lamp combination of claim 1, wherein said dimmer comprises a user touch interface.

10. The dimmer and LED lamp combination of claim 1, wherein said dimmer comprises indicators, said indicators used to indicate at least one of the following to a user:

setting a power level for said lamp;

a power level of said lamp;

readiness to select a CCT value for said lamp;
setting a CCT value for said lamp;
a CCT value for said lamp;
status of a lamp CCT adjustment process.

11. The dimmer and LED lamp combination of claim 1, wherein said lamp comprises circuitry to measure a CCT value for light emitted by the lamp.

12. An intelligent LED lamp comprising phase-cut angle detection circuitry and circuitry for the detection of a toggling event on the mains supply, wherein said lamp detects a first phase-cut angle in a mains voltage supplied to said lamp before or after detecting a toggling event, and wherein said lamp stores a first value corresponding to its power level at said first angle in a memory within said lamp, with the power level in said lamp regulated according to said first value subsequent to said toggling event, whether a phase-cut angle of said mains voltage remains at said first angle or reduces to a lesser angle.

13. The LED lamp of claim 12, wherein the power level in said lamp is regulated according to a phase-cut angle of said mains voltage if a change in said phase-cut angle is detected after a predetermined period.

14. The LED lamp of claim 12, wherein the lamp controls current through LEDs in said lamp to regulate the power level according to said first value.

15. A two wire dimmer circuit with an internal dimmer pool capacitor, wherein said dimmer conducts load current towards a load, and wherein said dimmer is characterised by the use of a controllable variable resistance in a series switching element within said dimmer to derive a dimmer supply voltage, said supply voltage falling across said variable resistance of the switching element, due to load current through said variable resistance, wherein said dimmer supply voltage is of sufficient magnitude to facilitate charging of said internal dimmer pool capacitor to a predetermined voltage.

16. The dimmer circuit of claim 15, wherein said variable resistance is controlled to only have a higher resistance, as used to derive said dimmer supply voltage for charging said pool capacitor to said predetermined voltage, for short periods relative to a load on-period.

* * * * *